US007079099B2

(12) United States Patent
Takatori

(10) Patent No.: US 7,079,099 B2
(45) Date of Patent: Jul. 18, 2006

(54) HOLD DISPLAY UNIT FOR DISPLAY OF A MOVING PICTURE

(75) Inventor: Ken-ichi Takatori, Tokyo (JP)

(73) Assignee: NEC Corporation, Tokyo (JP)

( * ) Notice: Subject to any disclaimer, the term of this patent is extended or adjusted under 35 U.S.C. 154(b) by 510 days.

(21) Appl. No.: 10/109,247

(22) Filed: Mar. 28, 2002

(65) Prior Publication Data

US 2002/0140658 A1 Oct. 3, 2002

(30) Foreign Application Priority Data

Mar. 30, 2001 (JP) ..... 2001-101705

(51) Int. Cl.
*G09G 3/36* (2006.01)

(52) U.S. Cl. ..... 345/89; 345/97; 345/103

(58) Field of Classification Search ..... 345/87–104, 345/76

See application file for complete search history.

(56) References Cited

U.S. PATENT DOCUMENTS 3,499,112 A * 3/1970 Zanoni et al. ..... 349/177
4,936,656 A * 6/1990 Yamashita et al. ..... 349/8
5,302,966 A * 4/1994 Stewart ..... 345/76
5,828,429 A * 10/1998 Takemura ..... 349/42
6,038,001 A 3/2000 Ono et al.
6,057,817 A 5/2000 Ono et al.
6,107,980 A * 8/2000 Hermanns et al. ..... 345/90
6,556,180 B1 * 4/2003 Furuhashi et al. ..... 345/87
6,600,472 B1 * 7/2003 Nakai et al. ..... 345/91
6,650,386 B1 * 11/2003 Shimoshikiryoh ..... 349/118
6,671,019 B1 * 12/2003 Petschek et al. ..... 349/129
6,747,621 B1 * 6/2004 Miyake ..... 345/87

OTHER PUBLICATIONS

"Electronic Technology", *Nikkan Kogyou News Paper* pp. 8-12 (1998), no translation.
"For LCD Unit to Replace CRT Monitor Market in the Moving-Picture View Point", *The Proceedings of LCD Forum Meeting* pp. 1-6 (1998), no English translation.
The Material of 62nd Joint Society Meeting pp. 1-5 (1998), no English translation.
Nakamura H. et al., "A Novel Wide-Viewing-Angle Motion-Picture LCD", *SID 98 Digest of Technical Papers* 11.5L pp. 20-23 (1998).

* cited by examiner

*Primary Examiner*—Dennis-Doon Chow
(74) *Attorney, Agent, or Firm*—Scully, Scott, Murphy & Presser, P.C.

(57) ABSTRACT

A hold LCD unit has an array of pixels including a first group of higher luminance pixels which pass a higher luminance state to a stable luminance state in each field, and a second group of lower luminance pixels which do not pass such a higher luminance state. The average luminance of the first group in each field assumes a desired luminance for each pixel of the first group. The configuration of the LCD unit removes the tail of moving object as observed in the moving picture.

35 Claims, 6 Drawing Sheets

HOLD DISPLAY UNIT FOR DISPLAY OF A MOVING PICTURE

BACKGROUND OF THE INVENTION (a) Field of the Invention

The present invention relates to a hold display unit (hold type display unit) for display of a moving picture and, more particularly, to a hold display unit such as a hold LCD unit for display of a moving picture. The present invention also relates to a monitor, a light valve and a projector using the hold display unit.

(b) Description of the Related Art

Recently, a twist nematic (TN) mode LCD device is generally used as a typical LCD device. The TN mode LCD devices are categorized into two modes: an active matrix mode, such as TN-TFT, wherein a thin-film-transistor (TFT) switch is provided in each of the pixels of the display unit; and a super twisted nematic (STN) mode. Although the STN mode has improved characteristics as to a contrast and a viewing angle dependency over the TN-TFT mode, it has the disadvantages of a lower-speed response. Thus, the STN mode display unit is not suited to display of a moving picture. The STN mode also has the disadvantage of a poor image quality compared to the TN-TFT mode, which is now more used in the commercial base.

In the circumstances as described above, techniques for improvement of the viewing angle dependency have been developed and are now used in the practical products. Thus, the main stream of the high-performance LCD device uses a TN mode in association with a compensation film, an in-plane switching mode, and a TFT active matrix mode using a multi-domain vertical-aligned technique.

In the active matrix mode LCD devices as described above, the image signal is updated at a cycle of 60 Hz, for achieving positive and negative updating each at a cycle of 30 Hz, whereby a single field has about 16.6 milliseconds. Thus, the sum of the positive and negative fields, called a frame, has about 33.3 milliseconds. It is to be noted that the response speed of the current LCD devices resides around this frame time at most. Thus, the LCD devices are requested to achieve a response speed higher than that achieving this frame time if the LCD devices are used for display of image signals such as for moving pictures, computer graphics or high-speed game pictures.

A variety of techniques have been studied for achieving a high-speed mode of the LCD devices. The techniques for obtaining a higher-speed operation for LCD devices are categorized in two main streams including one directed to using a higher-speed nematic liquid crystal (LC) as described above and the other directed to using a smectic LC having a spontaneous polarization and a higher response characteristic.

The first stream directed to the higher-speed nematic LC attempts the techniques of: reducing the cell gap to increase the electric field per applied voltage; applying a higher voltage to the LC layer to increase the electric field, thereby promoting or assisting the state change of the LC layer; reducing the viscosity of the LC; and employing a specific mode which is considered to inherently achieve a higher speed. By using these techniques, a current response time of several milliseconds has been achieved for the LCD units.

As such examples, there are a field-sequential display mode, and optically-compensated birefringence mode, which achieve response times between 2 to 5 milliseconds. Such techniques are described in "Electronic Technology" from Nikkan Kogyou News Paper, July 1998, pp 8–12, and "SID '94 Digest" in pp 927–930. By using these techniques, response times between 2 and 5 milliseconds have been achieved.

Examples of the smectic LCs having a spontaneous polarization in the second stream include surface stabilized ferroelectric liquid crystals (SSFLC), which is most popular among them and used in practical products. The SSFLC is reported to have a response time of about 100 microseconds (μs). A similar response time is also obtained by an anti-ferroelectric LC having three stable states. In addition, modes using deformed helix ferroelectric LC, non-threshold anti-ferroelectric LC, and LC using an electroclinic effect also achieve higher response times between several milliseconds and several tens of microseconds in an analog display format.

However, it is reported that these higher-speed LCs cannot also display moving pictures with a sufficient image quality. This is considered due to the display principle itself of the LCD unit. It is to be noted that display units other than the LCD unit, such as a CRT unit, emits own light for the display by self-luminescence, whereas the LCD unit displays images by using a shutter function of the LC layer which transmits or blocks the light that is incident thereto by transmission or reflection.

In the operation of the CRT unit, the electron beam is irradiated to a phosphor for fluorescence. The lifetime of the fluorescent member depends on the phosphor and the objective of the. CRT unit. For example, in the long-persistence oscilloscope such as for radar, a phosphor is generally used which has a longtime fluorescence as long as several hundreds of milliseconds, during which the intensity of light reduces down to 10% of the original light. On the other hand, in a flying-spot scanning tube, a phosphor is generally used which has a short-time fluorescence as short as 100 nanoseconds. In a CRT unit used for display of moving pictures, a phosphor having a short-time fluorescence is used.

FIG. 1 shows a timing chart of the luminance of such a CRT unit for display of moving pictures in each field, wherein the luminance is higher only for an initial duration of the each field and reduces abruptly in the following duration of the each field, showing an impulse type luminance.

On the other hand, the shutter mode of the LCD device allows the luminance to be constant in each field to obtain a hold type luminance, as shown in FIG. 2, In FIG. 2, the solid line shows the case of an ideal high-speed response whereas the dotted line shows the case of a practical lower-speed response, illustrating the hold type luminance.

The impulse type luminance and the hold type luminance are examined for their display performances in the literatures such as proceedings of LCD Forum meeting, entitled "For LCD unit to replace CRT monitor market in the moving picture view point", Aug. 8, 1998, pp 1–6, and a material of 62nd Joint Society meeting, Nov. 20, 1998, pp 1–5, held by division of Intelligent Organic Material of LC material, in 142 Committee of Organic Material Division of Jpn. Science Promotion Institute. These literatures include illustrations of the impulse type display and the hold display, showing how the moving character is observed differently therebetween. The illustrations are incorporated herein and shown as FIGS. 3A and 3B after miner modifications.

FIGS. 3A and 3B each shows the results of observation of the moving picture on the screen by a human eye, wherein character (or object) "A" moves in the direction of arrow, i.e., rightward direction. FIGS. 3A and 3B correspond to a CRT unit and a LCD unit, respectively.

On the CRT unit, as shown in FIG. 3A, the character A appears on a first location of the screen at an instant, disappears at the next instant, again appears at the next time on a second location apart from the first location, and again disappears at the next instant. On the LCD unit having a higher-speed response, as shown in FIG. 3B, the character A appears on a first location of the screen, stays at the first location until a next scanning period, moves abruptly from the first location to a second location at the next scanning period, and stays at the second location until a further next scanning period.

When the character A is traced by the human eye along the movement thereof on the CRT unit, as shown in FIG. 3A, the character is observed only at the luminescence thereof by the human eye, which tends to trace the character while moving at a constant speed. This allows a natural movement of the character. On the other hand, when the character is traced by the human eye along the movement thereof on the LCD unit, as shown in FIG. 3B, the character is observed for a while at the first location by the human eye, which tends to trace the character while moving at a constant speed. This causes the character to be observed as if the character moves on the retina of the human eye toward the leftward direction opposite to the moving direction of the character. Thus, the character is observed to have a tail, which hinders the character from being observed clearly.

In the analysis of observation by the human eye, it is noted that improvement of the response time alone is not sufficient for achieving suitable display of moving pictures by the hold LCD unit, and that the improvement should accompany specific holding schemes. The specific holding schemes are considered to include reduction of the hold time of the luminescence, and a configuration that the luminescent light is located in the vicinity of the locus of the movement of the character.

The reduction of the hold time can be achieved by a technique wherein a backlight source is periodically switched on and off in a high-speed LCD unit having a pi-cell structure using a compensation plate. This technique is described in the proceedings of the Forum of LCD Institute as described above, pp 20–23. Another technique for reduction of the hold time is such that the backlight source is normally turned on, with a reset state inserted therein. Such reduction is also described in the same proceedings of the Forum of the LCD Institute, pp 5–6.

As described above, in summary, the first problem in the prior art is that the hold LCD unit inherently degrades the image quality of the moving picture.

The second problem is that the shutter mode such as periodical switching or reset of the back light necessitates a complicated structure and yet achieves a limited effect, because sufficient improvement is only achieved by a longer dark time inserted therein. For example, for obtaining a display performance in the LCD unit comparable to the performance of the CRT unit, a single field should include a 1-millisecond-long bright time and a remaining dark time. In the periodical switching of the backlight, the drive circuit having a high driving voltage for the backlight is difficult to operate with a higher frequency without raising the costs thereof. On the other hand, in the reset of the backlight, a sufficient luminance is only achieved by a high-speed response of the LCD layer.

SUMMARY OF THE INVENTION

In view of the above problems in the conventional bold display unit, it is an object of the present invention to provide a hold display unit which is capable of suppressing tail of a moving object generally observed on the screen of the hold display unit.

The present invention provides a hold display unit including a display panel defining therein an array of pixel elements, and a drive circuit disposed in association with the display panel for driving the pixel elements, wherein the drive circuit divides the pixel elements into a first group having a higher luminance and a second group having a lower luminance based on gray scale levels of the pixel elements, wherein each pixel element of the first group passes a higher luminance gray scale level to reach a specified gray scale level in each field, and each pixel element of the second group reaches a specified gray scale level in each field without passing a higher luminance gray scale level.

In accordance with the hold display unit of the present invention, passing through the higher luminance gray scale level to reach the specified gray scale level for the pixel having a higher gray scale level allows removal of the tail of a moving object of the moving picture without using a complicated structure of the drive circuit.

The above and other objects, features and advantages of the present invention will be more apparent from the following description, referring to the accompanying drawings.

PREFERRED EMBODIMENTS OF THE INVENTION

Figure 1:
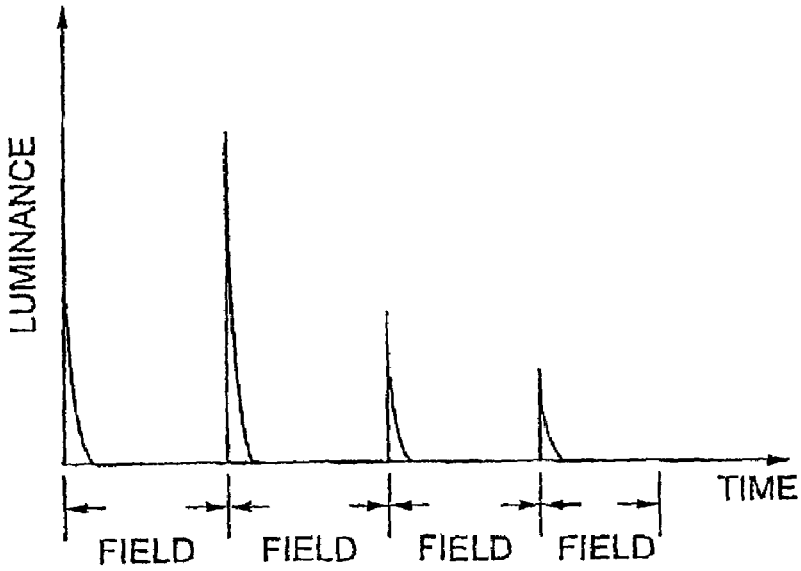
FIG. 1 PRIOR ART
FIG. 1 is a luminance profile of a typical CRT unit with respect to time.
Figure 2:
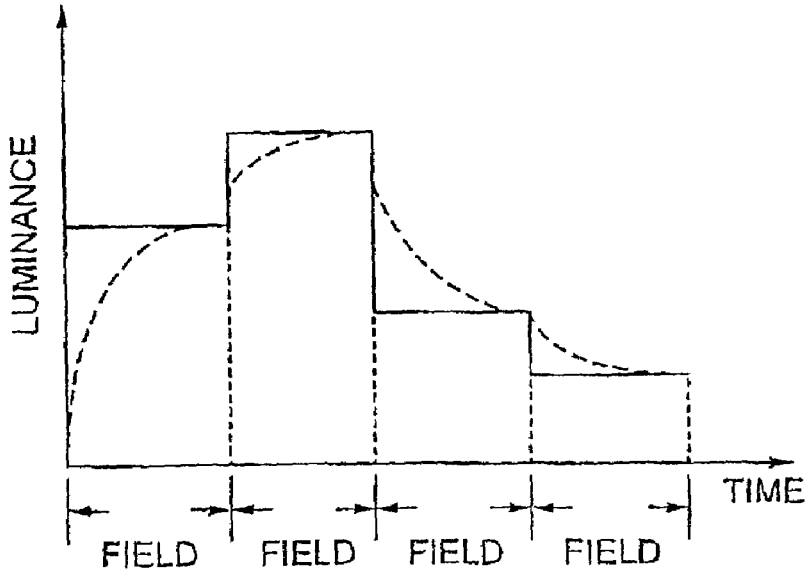
FIG. 2 PRIOR ART
FIG. 2 is a luminance profile of a conventional LCD unit with respect to time.

Now, the present invention is more specifically described with reference to accompanying drawings, wherein similar constituent elements are designated by similar reference numerals.

In a LCD unit according to the present invention, the pixels of the pixel array are divided into a first group having higher gray scale levels and a second group having lower gray scale levels in each field of the moving picture.

Figure 4:
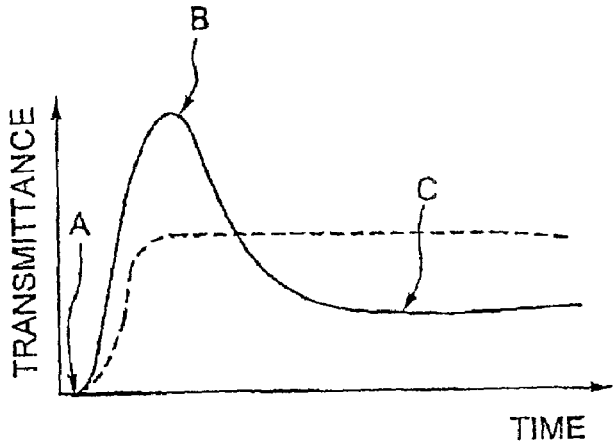
FIG. 4 is a transmittance profile, with respect to time, of a hold LCD unit according to an embodiment of the present invention.

Referring to FIG. 4, the solid line shows the transmittance of a pixel of the first group having higher luminance gray scale levels in the field, whereas the dotted line shows the effective luminance of the pixel having the transmittance shown by the solid line. The term "effective luminance" as used herein means a luminance sensed by the human eye, which generally senses the integral of the luminance of the pixel. The pixel of the first group passes the higher luminance gray scale level, whereas a pixel of the second group having lower gray scale levels does not pass the higher luminance gray scale level.

It is to be noted that the transmittance of the pixel having higher luminance gray scale level is zero or minimum at point "A", rises abruptly to a highest transmittance at peak point "B" and falls to a lower stable transmittance at point "C". That is, the pixel passes a transmittance higher than a specified transmittance. On the other hand, the transmittance of a pixel having a lower luminance gray scale level rises moderately to a stable transmittance without passing a transmittance higher than a specified transmittance.

The hold LCD unit of the first embodiment has preferably a polarizing plate in association with the LC layer (second embodiment), or more preferably a pair of polarizing plates sandwiching therebetween the LC layer (third embodiment). The specified embodiment between the parentheses means the embodiment which has the specific preferable structure recited.

The LC layer in the hold LCD unit of the second or third embodiment preferably has a response characteristic wherein the response of the LC layer to the odd-numbered powers of the electric field is higher than the response of the LC layer to the even-numbered powers of the electric field.

The LC layer in the hold LCD unit of the second or third embodiment having a polarizing plate or a pair of polarizing plates preferably includes a ferroelectric LC (fifth embodiment) or an anti-ferroelectric LC (sixth embodiment).

The LC layer in the hold LCD unit of the second or third embodiment having a polarizing plate or a pair of polarizing plates preferably includes an LC substance having an electroclinic phenomenon (seventh embodiment).

The pair of polarizing plates in the hold LCD unit of one of the third through seventh embodiments preferably have optical axes extending perpendicular to each other (eighth embodiment).

The refractive-index ellipsoid of the LC layer in the hold LCD unit of the second or eighth embodiment has a projection on the substrate surface or panel surface, the projection being an ellipse having a longer axis and a shorter axis (ninth embodiment). In the ninth embodiment, the direction of the in-plane rotation of the LC layer when an electric field having a specific polarization is applied to the LC layer is different from the direction of the in-plane rotation of the LC layer when an electric field having an opposite polarization is applied.

It is preferable that the longer axis of the ellipse in the ninth embodiment equally divide the angle formed between the transmission axes of the pair of polarizing plates when an electric field is not applied (tenth embodiment). When an electric field having the specific polarization is applied, the longer axis of the LC layer rotates toward the optical axis of one of the pair of polarizing plate, whereas when an electric field having the opposite polarity is applied, the longer axis rotates toward the optical axis of the other of the pair of polarizing plates.

Figure 5A:
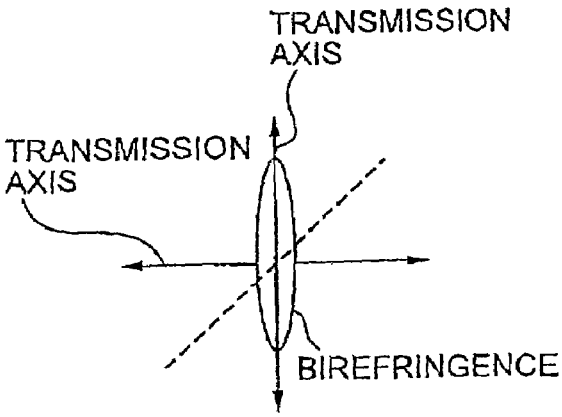
FIGS. 5A to 5C each shows the relationship between the transmittance axes of a polarizing plate and the direction of the birefringence of the LC layer.
Figure 5B:
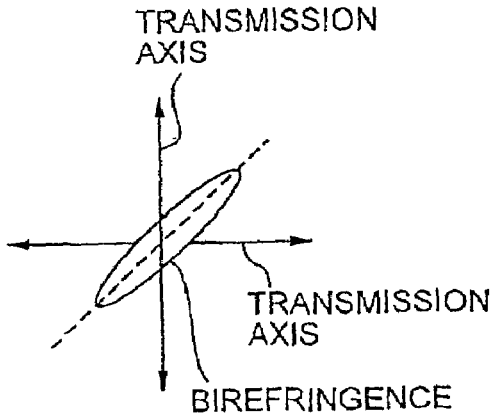
Figure 5C:
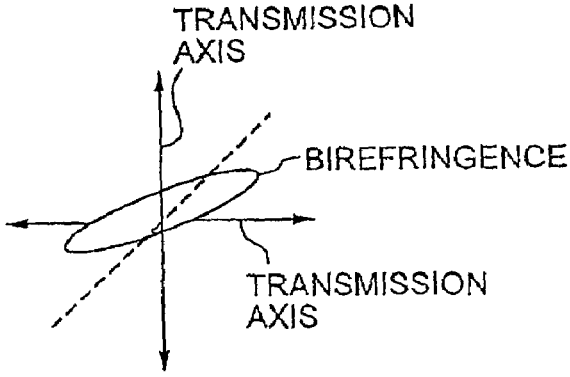

Referring to FIGS. 5A to 5C, there is shown the birefringence average direction of the LC layer on the coordinate defined by the transmission axes (optical axes) of both the polarizing plates constituting the ordinate and the abscissa. The birefringence average direction is shown by the projection of the refractive-index ellipsoid projected on the substrate surface. As illustrated, the transmission axes of both the polarizing plates extend perpendicular to each other, and a dotted line divides the angle formed between the transmission axes.

Figure 3A:
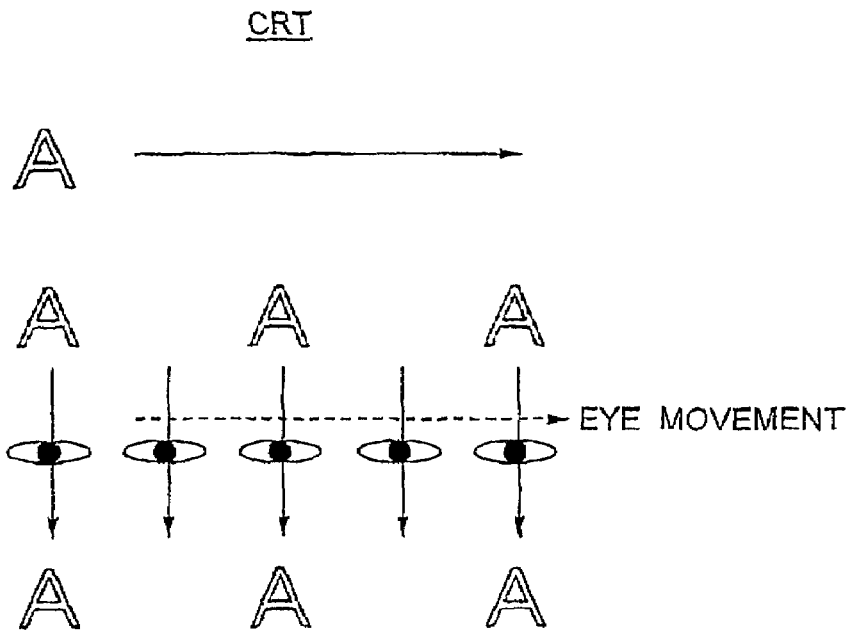
FIG. 3A PRIOR ART
FIGS. 3A and 3B are explanatory views for showing relationship between a moving object and the moving picture observed on the CRT screen and the LCD screen, respectively, by a human eye.
Figure 3B:
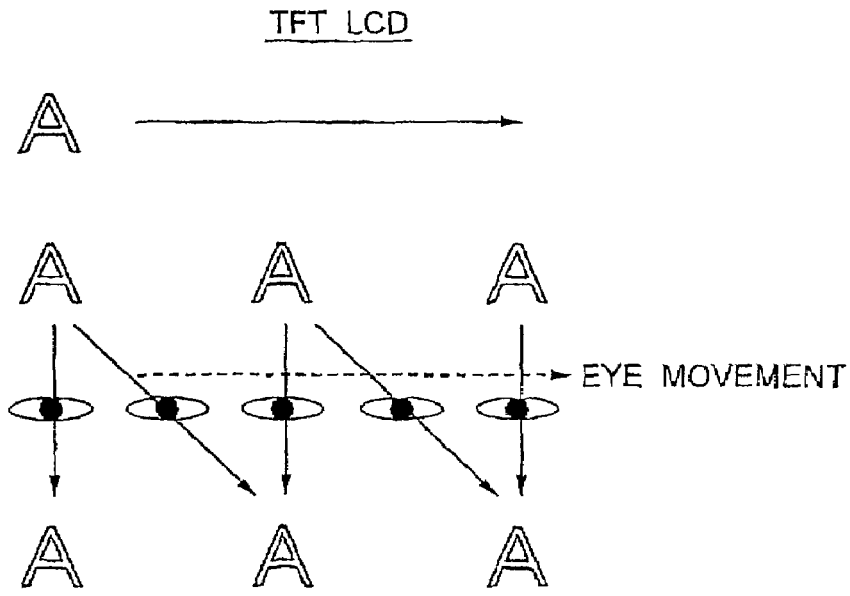
FIG. 3B PRIOR ART

In FIG. 5A, the longer axis of the birefringence average direction of the LC layer is aligned with the transmission axis of the one of the polarizing plates. This allows the LCD unit to display a black level wherein the light transmission is at the minimum. In FIG. 5B, the longer axis of the birefringence average direction resides at the direction equally dividing the angle formed between the ordinate and the abscissa, i.e., between the transmission axes of the polarizing plates. This allows the LCD unit to display a white level wherein the light transmission is at the maximum. In FIG. 5C, the longer axis of the birefringence average direction resides in the vicinity of the abscissa after rotation in the opposite direction shown in FIG. 5A. This allows the LCD unit to display a gray scale level, which resides between the levels in FIGS. 3A and 3B.

The change of the gray-scale level from the state of Fig. FIG. 5A to the state of FIG. 5C via the state of FIG. 5B corresponds to the point from A to point C via point B shown by the transmittance profile of FIG. 4. The specific polarity of the electric field corresponds to FIG. 5A, whereas the opposite polarity of the electric field corresponds to FIG. 5B.

By adjusting the directions of the polarizing plates and the LC layer as well as adjusting the polarization of the electric field, the LCD unit has a desired performance.

The refractive-index ellipsoid of the LC layer in the LCD unit of the second or eighth embodiment preferably has a projection on the substrate surface, which is of ellipse having a longer axis and a shorter axis (11th embodiment). In this embodiment, the longer axis of the LC layer rotates in a plane when an electric field having a specific polarization is applied, whereas the longer axis scarcely rotates in the plane when an electric field having the opposite polarization is applied.

The LC layer of the LCD unit of the eleventh embodiment preferably has a specific characteristic of the longer axis in the projection of the refractive-index ellipsoid projected on the substrate surface (12th embodiment). The specific characteristic is such that the longer axis of the LC layer is aligned with the transmission axis of one of the pair of polarizing plates when no electric field or an electric field having a specific polarization is applied, and that the longer axis rotates toward the transmission axis of the other of the pair of polarizing plates when an electric field having the opposite polarization is applied.

The LC layer in the hold LCD unit of the second or third embodiment may have a specific characteristic wherein the response of the LC layer to the even-ordered powers of electric field is larger than the response of the LC layer to the odd-numbered powers of the electric field (13th embodiment). The odd-numbered powers of the electric field includes first, third, fifth powers, whereas the even-numbered powers include second, fourth, sixth powers.

The hold LCD unit of the second or third embodiment may have a nematic LC as the LC material (14th embodiment). The LCD unit of the second or third embodiment may also have a cholestric LC (chiral nematic LC) as the LC material (15th embodiment).

The pair of polarizing plates in the hold LCD unit of one of the 13th to 15th embodiments preferably have optical axes extending perpendicular to each other (16th embodiment).

The refractive-index ellipsoid of the LC layer in the hold LCD unit of the second or sixteenth embodiment may have a projection on the substrate surface, the projection being of an ellipse having a longer axis and a shorter axis (17th embodiment). In this embodiment, the longer axis of the ellipse is aligned with the transmission axis of one of the polarizing plates when no electric field is applied, whereas the longer axis rotates toward the transmission axis of the other of the polarizing plates.

The hold LCD unit of the second or third embodiment preferably has an optical compensation plate having a function of changing the transmission-voltage characteristics of the LC layer (18th embodiment).

The optical compensation plate in the hold LCD unit of the 18th embodiment preferably uses a higher voltage range for a display operation (19th embodiment). The operation of the hold LCD units of the eighteenth and nineteenth embodiments will be described hereinafter.

Figure 6:
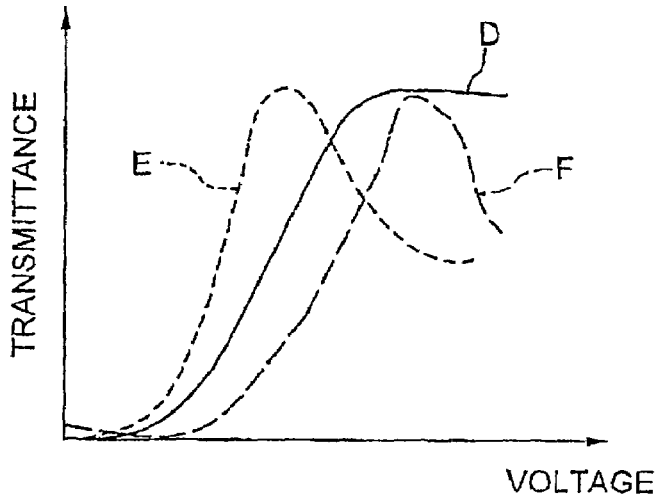
FIG. 6 is a graph showing the relationship between the transmittance of the LC layer and the applied voltage without using a compensation plate.

Referring to FIG. 6, there are shown transmittance characteristics with respect to the applied voltage in hold LCD units. The solid line "D" shows the transmittance characteristic of a typical hold LCD unit including no optical compensation plate. By incorporating an optical compensation plate in the typical hold LCD unit, the transmittance characteristic with respect to the voltage can be changed to obtain transmittance characteristics such as "E" and "F" wherein the peak of the luminance is shifted toward the lower voltage range and the higher voltage range, respectively. In the transmittance characteristic "E", for example, it is possible to obtain the transmittance profiles with respect to time shown by the solid line and the dotted line in FIG. 4 by controlling the applied voltage.

The hold LCD unit of the 19th embodiment is especially suited to a high-speed response. By using the transmittance characteristic "F" having a peak shifted toward the higher voltage range, a high-speed response can be achieved in the LCD unit of the nineteenth embodiment.

Figure 7:
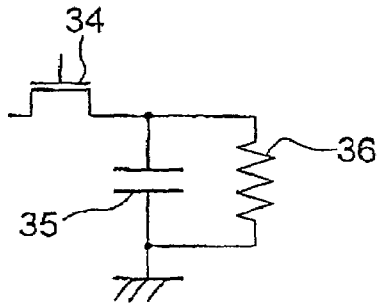
FIG. 7 is an equivalent circuit diagram of a pixel element in an active matrix hold LCD unit according to an embodiment of the present invention.

The hold LCD unit of the second and third embodiments preferably has a pixel wherein a parallel resistor is connected in parallel with the LC layer called herein LC capacitor (20th embodiment), as shown in FIG. 7.

The active matrix LCD unit has a TFT switch 34 for storing charge on the LC capacitor 35. The charge stored on the LC capacitor 35 is discharged through the parallel resistor 36, as a result of which the orientation of the LC layer is changed. By allowing the change of the LC orientation due to the discharge to reduce the transmittance, the operation of the second and the third embodiments can be implemented.

In the LCD unit of the 20th embodiment, the RC time constant defined by the parallel resistor 36 and the LC capacitor 35 is preferably comparable to a single field period or smaller (21st embodiment).

In the LCD unit of the second or third embodiment, it is preferable that ions be injected or incorporated in the LC layer (22nd embodiment).

In the LCD unit of the 2nd embodiment, it is preferable that the time constant determined by the ion density and the diffusion coefficient be comparable to a single field period or smaller (23rd embodiment).

In the LCD unit of the 23rd embodiment, the positive ions and the negative ions may have approximately the same value in the product of the ion charge and the number of ions, which determines the total charge, whereby the LC layer is electrically neutral (24th embodiment).

In one of the 22nd through 24th embodiments, a configuration similar to the configuration of the 20th or 21st embodiment can be achieved by the ions instead of the parallel resistor.

In one of the first through 24th embodiments, a switch such as a TFT switch may be provided for driving a pixel (25th embodiment).

In the 25th embodiment, the switch may introduce charge onto the LC capacitor of the pixel with a specified time constant during the hold period of the pixel (26th embodiment).

In the 26th embodiment, a higher voltage between the terminals of the switch allows a higher amount of charge to be introduced by the switch during the hold period of the pixel (27th embodiment).

Figure 8:
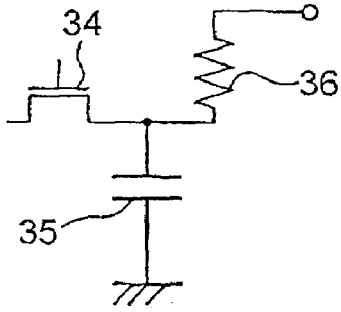
FIG. 8 is an equivalent circuit diagram of a pixel element in an active matrix hold LCD unit according to another embodiment of the present invention.

In the 25th embodiment, a serial resistor may be connected serially with the pixel capacitor, or LC capacitor, between the power source lines (28th embodiment), as shown in FIG. 8. FIG. 8 shows the case of an active matrix LCD unit, and the switch 34 is not necessary in the case of a LCD unit other than the active matrix LCD unit.

In operation of the 28th embodiment, the drive of the pixel is conducted by charging the LC capacitor 35 through the switch 34 (in the case of active matrix LCD unit), whereas electric charge is also introduced through the serial resistor 36 with the specified time constant. The introduction of charge changes the LC orientation. By allowing the change of the LC orientation due to the charge introduction to reduce the transmittance of the LC layer, the operation of the second and third embodiments can be obtained.

In the 28th embodiment, the resistance of the serial resistor may reside between the ON-resistance and the OFF-resistance of the TFT switch (29th embodiment).

In the 29th embodiment, the hold display unit may be a self-luminescence unit, such as a CRT and an electroluminescence display unit (30th embodiment).

The display units of the first through 30th embodiments may be used as monitor units, light valves and projectors.

Figure 9:
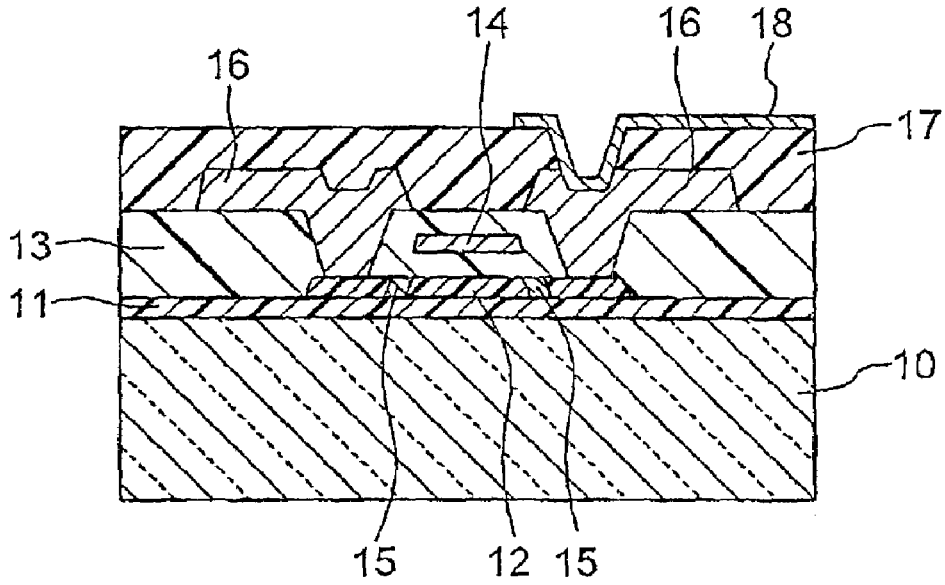
FIG. 9 is a sectional view of a polysilicon TFT switch in the LCD unit of FIG. 4.
Figure 10:
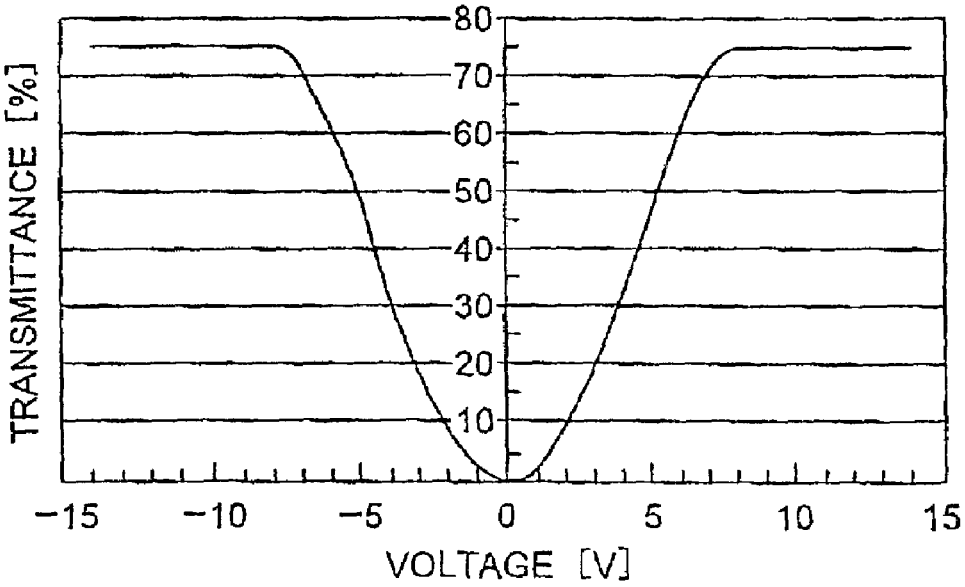
FIG. 10 is a graph showing the relationship between the transmittance of the LC layer and the applied voltage in a hold LCD unit according to an embodiment of the present invention.

Referring to FIG. 9, a practical first example of the LCD unit of the present invention was manufactured which had an array of pixel elements each including a polysilicon TFT switch. The LC layer had a V-character characteristic between the transmittance and the applied voltage, such as shown in FIG. 10. The LCD unit was manufactured as follows.

A silicon oxide film 11 was formed on a glass substrate 10, followed by growth of an amorphous silicon film. Subsequently, an excimer annealing is conducted to the amorphous silicon film to change the same to a polysilicon film 12. A 100-angstrom-thick silicon oxide film 13 is further grown, followed by patterning thereof to form openings therein. After forming a photoresist mask for LDD regions, source/drain regions are formed in the polysilicon film 12 by introducing phosphorous ions into the polysilicon film 12.

After another silicon oxide film 13 is grown, microcrystal silicon (μ-c-Si) and tungsten silicide (WSi) were consecutively grown thereon, followed patterning of the microcrystal silicon and the tungsten silicide to form a gate electrode 14. LDD regions 15 were then formed by introducing phosphorous ions through the photoresist mask. Thereafter, a silicon oxide film and a silicon nitride film 17 were consecutively grown, followed by patterning thereof to form contact holes, sputtering aluminum and titanium, and patterning thereof to form source/drain electrodes 16. After a silicon nitride film 17 was deposited, openings for contact plugs were formed therein. Finally, an ITO film was formed and patterned to form a transparent pixel electrode 18, thereby obtaining a TFT array having the structure shown in FIG. 9.

On the glass substrate, an array of pixels each having a TFT was formed, with the driving circuit being formed on a single crystal substrate outside the glass substrate. The TFT panel thus manufactured and a counter panel, wherein a counter electrode and a Cr shield mask pattern are formed, are disposed opposing to each other, after an array of columns had been formed on the counter panel. The column array had a height if 1.8 micrometers and had a function of a spacer for maintaining a gap between both the panels as well as resistance against an external shock.

Outside the area for the pixel array, the counter panel was coated with a ultra-violet-cured seal resin. After both the panels wee bonded together. LC was injected therebetween. A smectic LC was used as the LC material, which had a V-characteristic of transmittance with respect to the applied voltage for achieving a continuous gray-scale-level display. The LC material used was a non-threshold, anti-ferroelectric LC, which had the characteristic shown in FIG. 10 in the experimental test wherein the LC was sandwiched between a pair of polarizing plates disposed in crossed nicols so that the LC exhibited a black level upon no applied voltage.

In the practical embodiments, the polarizing plates are such that exhibits the function as shown in FIGS. 5A to 5C which is somewhat different from the experimental test. The embodiments include the third, fourth, sixth, eight to tenth, and 25th embodiments.

In the above embodiments, the signal processing circuit is different from the normal signal processing circuit in the conventional LCD unit. More specifically, the signal processing circuit generates in a higher luminance gray scale level a signal that reverses the polarity of the applied voltage at every field change, whereby the transmittance passes a higher level to a stable level. The signal processing circuit also generates in a lower luminance gray scale level a signal that continues the polarity of the applied voltage which depends on the prior polarity, whereby a lower luminance is maintained.

In the above signal processing, the impulse response can be achieved to remove the tail of the moving object on the LCD screen. In addition, a higher contrast can be also achieved because the lower luminance level stays at the lower level.

In the present example, 256 gray scale levels are used including a 0-th level for the minimum luminance and 255th level for the maximum luminance, wherein the group of higher luminance levels and the group of lower luminance levels are divided by a level between 63th gray scale level and 64th gray scale level. The dividing level is not limited to this specific level and should be determined depending on the display characteristics of the LC material, the degree of complexity of the signal processing circuit, results of observation of the display etc. In our experimental test, even when a dividing level is set between 254th gray scale level and 255th gray scale level, the degree of effect for removing the tail of the moving object was satisfactory over the conventional LCD unit. This is considered to result from the fact that the tail phenomenon at the higher luminance is most noticeably observed by the human eye.

A second example of the present invention is similar to the first example except for the configuration and the operation of the signal processing section. More specifically, in the second example, in view that the DC component of the display signal causes electrical burning of the LCD screen after lower luminescence levels continue, the signal polarity is reversed by a counter which counts the number of frames of the lower luminance levels. This is employed because the lower luminance levels use a single polarity in the LCD unit of the present invention for not passing the higher transmittance level, which is inconsistent with the normal AC drive for the LCD unit. This arrangement improves the lifetime of the LCD unit.

A third practical example uses a counter similar to that used in the second practical example. The third practical example uses, in addition to the counter, a voltage integrator which determines the reversion of the signal polarity after integrating the signal voltage. The voltage integrator is associated with a frame memory for integrating the signal voltage for every pixel. For example, assuming that a positive 0th gray scale level at +5 volts continues for four frames and subsequently a negative 63th gray scale level at −3 volts continues for 4 frames, the integrator calculates the integrated voltage at +8 volts. This generates a DC component having a positive polarity. Thus, the polarity is not reversed and the negative polarity is continued in this case irrespective of the count of the counter.

In the present example, the DC component can be removed while considering the actual value for the DC component. Thus, the third example achieves improvement of lifetime over the second example. The integration is conducted for each pixel in the above example. However, the integration may be conducted for an area of several pixels such as including four adjacent pixels. The integration may also be conducted for the whole display area.

A fourth practical example uses periodical turn-on of the backlight wherein the backlight is turned on and off in synchrony with the polarity reversion for the pixels having lower luminance levels, in addition to the configuration of the first or second example. This configuration is used because the polarity reversion tends to reduce the contrast due to passing the higher luminance state. By employing a dark state of the backlight during the polarity reversion, the leakage of light was avoided, whereby an excellent contrast could be achieved.

In the first through fourth examples, the LC material was non-threshold and anti-ferroelectric LC was used. However, other LC materials such as ferroelectric LC, anti-ferroelectric LC and ferroelectric-phase LC materials, as well as a short-pitch LC material having an extremely small pitch winding, a stabilized LC material stabilized by high molecules, a single-stabilized ferroelectric LC material or any LC material so long as the LC material has a V-characteristic of transmittance with respect to the applied voltage.

A fifth practical example uses a nematic LC operating with the in-plane switching (IPS) mode. The LC material has a poor response when used at room temperature. The satisfactory higher response of the present invention could be obtained at a higher temperature while using the IPS mode. The fifth example also achieved satisfactory display of moving picture similarly to the above examples. In the present example, the electrodes had a shape of inclined L-character. The typical IPS mode LCD unit generally suffers from undesired coloring as viewed diagonally. The specific electrode structure removed the coloring to obtain a wide viewing angle. This advantage may be achieved by a further high-speed LC material and a high-speed driving technique which may be achieved in the future, instead of the higher temperature as used in the present example, A sixth practical example is such that the present invention is applied to an LCD unit having a compensation plate in association with a pi-cell called optically-compensated birefringence. This structure achieves a wider viewing angle.

In the present example, the structure of the compensation plate may be changed to obtain a complementary pi-cell structure mode. The sixth example experimentally manufactured had 480 gate bus lines and 640 drain bus lines made of sputtered Cr, wherein the line width was 10 micrometers and the gate insulation film was made of silicon nitride (SiNx). Each pixel was 330 micrometers long and 110 micrometers wide, and had an amorphous silicon TFT, with the common electrode being made of sputtered ITO (indium-tin-oxide).

Figure 11:
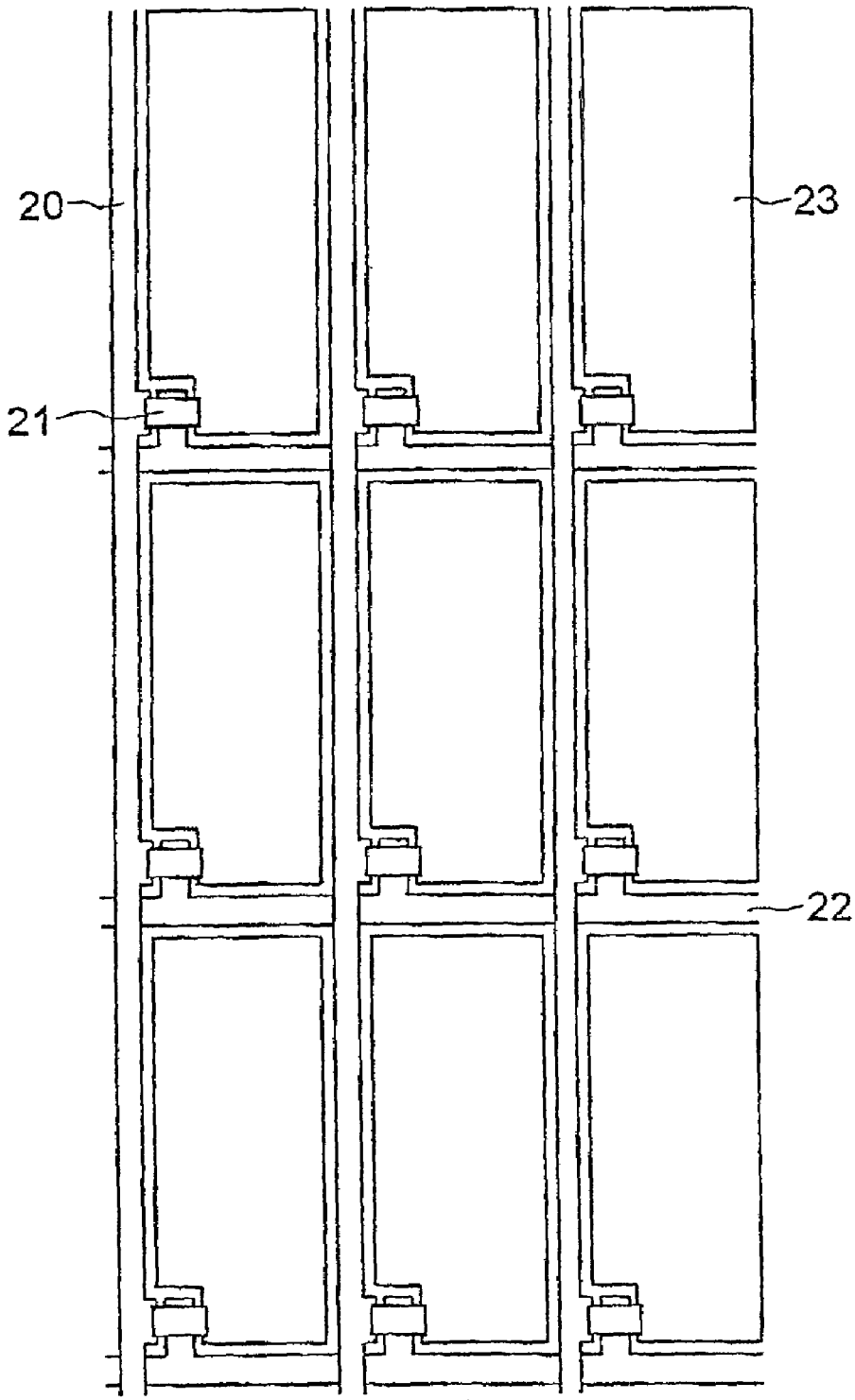
FIG. 11 is a top plan view of the pixel area of a hold LCD unit according to an embodiment of the present invention.

Referring to FIG. 11, the LCD unit of the sixth example includes an array of pixels each including a pixel electrode 23 and a TFT 21, a plurality of drain bus lines 20 extending in the column direction, and a plurality of gate bus lines 21 extending in the row direction. The LCD unit was manufactured as follows.

The TFT panel was manufactured by forming an array of the TFTs on a glass substrate. The counter panel included a Cr shield film pattern formed on a glass substrate, and an array of color filters formed by a dying technique. The color filters each had a thickness of 1.5 micrometers, forming a 4.5-micrometer-thick filter structure having an uneven surface by arranging three primary color filters. After coating a transparent resin on the color filter structure to achieve a total thickness of 6 micrometers, the counter panel was disposed opposing to the TFT panel.

Polyamic acid was coated onto the TFT substrate and the counter substrate, followed by baking at 200° C. to form polyimide orientation films on the respective panels. A roller having a diameter of 50 mm and wound by a buffering cloth made of rayon is used for parallel rubbing of the surfaces of the polyimide orientation films. The roller is moved at a rotational speed of 600 rpm, at a shifting speed of 400 mm/second on the polyimide film, depression amount of 0.7 mm for each of the twice rubbing operations. The polyimide orientation films had a thickness of about 500 angstroms as measured with a contact step meter, and the resultant pre-tilt angle of the LC layer was 7 degrees as measured with a crystal rotation technique.

One of the resultant TFT panel and counter panel was coated with a ultra-violet-cured seal resin wherein glass rod spacers of a columnar shape having a diameter of 6 micrometers were dispersed. Both the panels were disposed opposing to each other, with the directions of the rubbing on both the panels being parallel to each other, followed by curing the seal resin by non-contact irradiation of ultraviolet ray, to thereby obtain a combination panel having a gap of 6 micrometers. The gap is filled with a nematic LC material.

The resultant panel is attached with a compensation plate designed to have a optically-compensated birefringence display mode, described in "SIOD 94 Digest " pp 927–930, thereby obtaining a final LCD panel. The LCD panel is attached with a LC driver to obtain a hold LCD unit, which achieved a high-speed response and a wide viewing a angle. By changing the arrangement of the compensation plate as well as the driving signal, the LCD unit had configurations according to the embodiments of the present invention.

As described above, the LCD units of the present embodiments improve the image of the moving object by removing or alleviating the tail of the moving object, by passing a higher luminance state to reach a stable luminance state in each field, with the average luminance in the field corresponding to the desired level.

In addition, the LCD units prevent electrical burning of the LCD screen by using the counter etc. for polarity reversion of the signal voltage.

Since the above embodiments are described only for examples, the present invention is not limited to the above embodiments and various modifications or alterations can be easily made therefrom by those skilled in the art without departing from the scope of the present invention.

What is claimed is:

1. A hold display unit comprising a display panel defining therein an array of pixel elements, and a drive circuit disposed in association with said display panel for driving said pixel elements, wherein said drive circuit divides said pixel elements into a first group having a higher luminance and a second group having a lower luminance based on gray scale levels of said pixel elements, wherein each pixel element of said first group passes a luminance gray scale level higher than a specified transmittance to reach a specified gray scale level in each field, said each pixel element of said first group has in each field an average gray scale level, which is equal to a desired gray scale level, and wherein each pixel element of said second group reaches a specified gray scale level in each field without passing the luminance gray scale level higher than a specified transmittance.

2. The hold display unit as defined in claim 1, wherein said display panel is an LCD panel having an LC layer.

3. The hold display unit as defined in claim 2, wherein said LCD panel is associated with a polarizing plate.

4. The hold display unit as defined in claim 2, wherein said LC panel is sandwiched between a pair of polarizing plates.

5. The hold display unit as defined in claim 2, wherein said LC layer responds to odd-numbered powers of an electric field with a higher degree than to even-numbered powers of said electric field.

6. The hold display unit as defined in claim 2, wherein said LC layer includes a ferroelectric LC material.

7. The hold display unit as defined in claim 2, wherein said LC layer includes an anti-ferroelectric LC material.

8. The hold display unit as defined in claim 2, wherein said LC layer includes an electroclinic LC material.

9. The hold display unit as defined in claim 4, wherein said polarizing plates have optical axes extending perpendicular to each other.

10. The hold display unit as defined in claim 2, wherein said LC layer has a refractive-index ellipsoid, which has a projection of ellipse on a substrate surface, said ellipse having a longer axis rotating in a first direction upon application of a first electric field having a first polarity.

11. The hold display unit as defined in claim 10, wherein said longer axis rotates in a second direction opposite to said first direction upon application of a second electric field having a second polarity opposite to said first polarity.

12. The hold display unit as defined in claim as defined in claim 11, wherein said longer axis equally divides an angle formed between optical axes of said pair of polarizing electrodes upon application of no electric field.

13. The hold display unit as defined in claim 10, wherein said longer axis scarcely rotates upon application of a second electric field having a second polarity opposite to said first polarity.

14. The hold display unit as defined in claim as defined in claim 13, wherein said longer axis is aligned with a optical axis of one of said pair of polarizing plates upon application of no electric field and application of said second electric field.

15. The hold display unit as defined in claim 2, wherein said LC layer responds to even-numbered powers of an electric field with a higher degree than to odd-numbered powers of said electric field.

16. The hold display unit as defined in claim 2, wherein said LC layer includes a nematic LC material.

17. The hold display unit as defined in claim 2, wherein said LC layer includes a chiral nematic LC material.

18. The hold display unit as defined in claim 2, wherein said LC layer is sandwiched between a pair of polarizing plates having optical axes extending perpendicular to each other.

19. The hold display unit as defined in one of claims 16, 17 and 18, wherein said LC layer has a refractive-index ellipsoid, which has a projection of ellipse on a substrate surface, said ellipse has a longer axis aligned with an optical axis of one of said polarizing plates and rotating toward an optical axis of the other of said polarizing plates upon application of a first electric field having a first polarity.

20. The hold display unit as defined in claim 2, wherein said LCD panel is associated with an optical compensation plate having a function for changing a transmittance characteristic of said LC layer with respect to an applied voltage.

21. The hold display unit as defined in claim 20, wherein said optical compensation plate allows said LC layer to operate at a higher voltage range.

22. The hold display unit as defined in claim 2, wherein a resistor is electrically connected in parallel with said LC layer.

23. The hold display unit as defined in claim 22, wherein said resistor and said LC layer define an RC constant which is comparable to a time of a single field or smaller.

24. The hold display unit as defined in claim 2, wherein said LC layer includes mixed ions.

25. The hold display unit as defined in claim 24, wherein a time constant defined by an ion density and diffusion coefficient of said LC layer is comparable to a time of a single field or smaller.

26. The hold display unit as defined in claim 25, wherein said LC layer includes positive ions and negative ions and is an electrically neutral.

27. The hold display unit as defined in claim 2, wherein each of said pixel elements includes a switch.

28. The hold display unit as defined in claim 27, wherein each pixel element receives electric charge at a specified time constant during a hold period of said each pixel element.

29. The hold display unit as defined in claim 28, wherein said switch introduces electric charge to an associated pixel element at a rate corresponding to a voltage applied between ends of said switch during a hold period of said associated pixel element.

30. The hold display unit as defined in claim 27, wherein a resistor is serially connected with said LC layer.

31. The hold display unit as defined in claim 30, wherein said resistor has a resistance between ON-resistance and OFF-resistance of said switch.

32. The hold display unit as defined in claim 1, wherein said display panel is a self-luminescence panel.

33. The hold display unit as defined in claim 1, wherein said display panel is a monitor display unit.

34. The hold display unit as defined in claim 1, wherein said display panel is a light valve.

35. The hold display unit as defined in claim 34, wherein said light valve implements a projector.

* * * * *